US005370419A

United States Patent [19]

Takayama

[11] Patent Number: 5,370,419

[45] Date of Patent: Dec. 6, 1994

[54] PURSE

[76] Inventor: Hiromitsu Takayama, 1109, 3-45, Takaido-Nishi 2-chome, SSuginami-ku, Tokyo, Japan

[21] Appl. No.: 146,759

[22] Filed: Nov. 2, 1993

[30] Foreign Application Priority Data

Nov. 20, 1992 [JP] Japan ..... 4-335334

[51] Int. Cl.[5] ..... B42D 3/18

[52] U.S. Cl. ..... 281/31; 281/34; 281/35; 281/38; 402/79; 150/147; 150/131; 150/113

[58] Field of Search ..... 150/147, 145, 150, 136, 150/131, 112, 113; 206/311; 281/38, 34–37, 31, 32; 402/79

[56] References Cited

U.S. PATENT DOCUMENTS

| | | | |
|---|---|---|---|
| 1,316,885 | 9/1919 | Fletcher | 206/311 |
| 2,369,864 | 2/1945 | Spaldo | 281/34 |
| 2,612,200 | 9/1952 | June | 150/136 |
| 2,727,549 | 12/1955 | Knee | 150/136 X |
| 2,926,932 | 3/1960 | Koerper | 281/34 |
| 3,353,844 | 11/1967 | Staats | 402/79 |
| 4,161,201 | 7/1979 | Carp | 150/113 X |
| 4,720,012 | 1/1988 | Dufour | 150/113 X |
| 5,295,577 | 3/1994 | Minter | 206/311 X |

*Primary Examiner*—Mark Rosenbaum
*Assistant Examiner*—Frances Han
*Attorney, Agent, or Firm*—Jordan and Hamburg

[57] ABSTRACT

A plurality of component holder members for a purse, each having a base plate arranged at one or both sides pockets or cases for carrying any of credit cards, bank cards, calling cards, commutation tickets, a driver's license, coins, banknotes, etc. and provided at one edge with joints, are applicable and a desired number of them can be joined together with a binder through their joints in order to form a particular configuration of the purse which is required by a user.

2 Claims, 21 Drawing Sheets

PURSE

BACKGROUND OF THE INVENTION

The present invention relates to a purse which comprises a combination of pocket holder members for carrying articles such as credit cards, bank cards, calling cards, coins, banknotes, commutation tickets, a driver's license, etc.

A conventional purse has compartments and pockets formed in a fixed combination for holding coins, banknotes, credit cards, and the like separately.

Hence, it is necessary for purse manufacturers to provide different types of the conventional purses to offer every user a choice. This requires the implementation of multiple-items and small-lot production and will result in high cost and low productivity. Also, the different purse types to be offered are limited in number and will hardly satisfy the users' demands.

SUMMARY OF THE INVENTION

It is an object of the present invention, in view of the foregoing drawbacks of the prior art, to provide an improved purse comprising a plurality of separate pocket holder members which can easily be assembled by a user to a desired combination for the particular use and also fabricated at lower cost.

The above and other objects and the novel features of the present invention will be apparent from reading the following description in conjunction with the accompanying drawings, It should be understood that the drawings are provided for ease of the description and will not be limitative of the invention.

DESCRIPTION OF THE PREFERRED EMBODIMENTS

Figure 1:
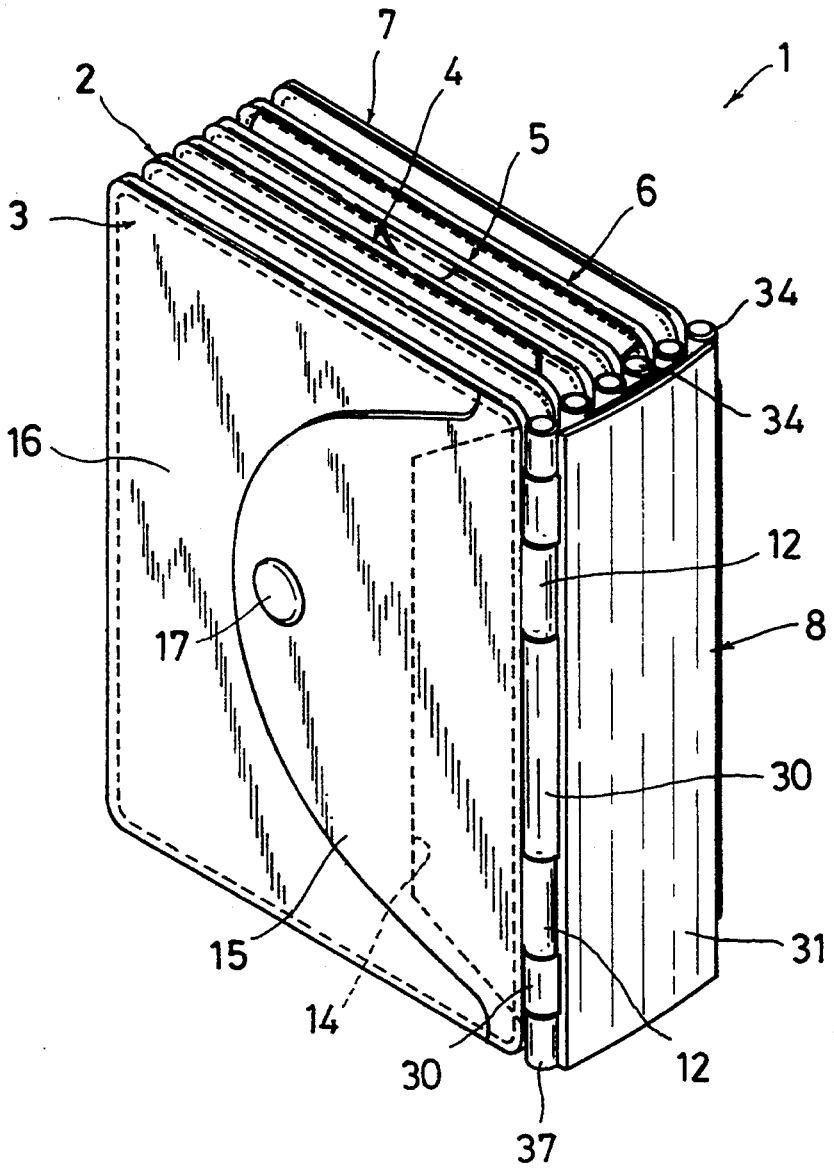
FIG. 1 is a perspective view showing a first embodiment of the present invention.
Figure 2:
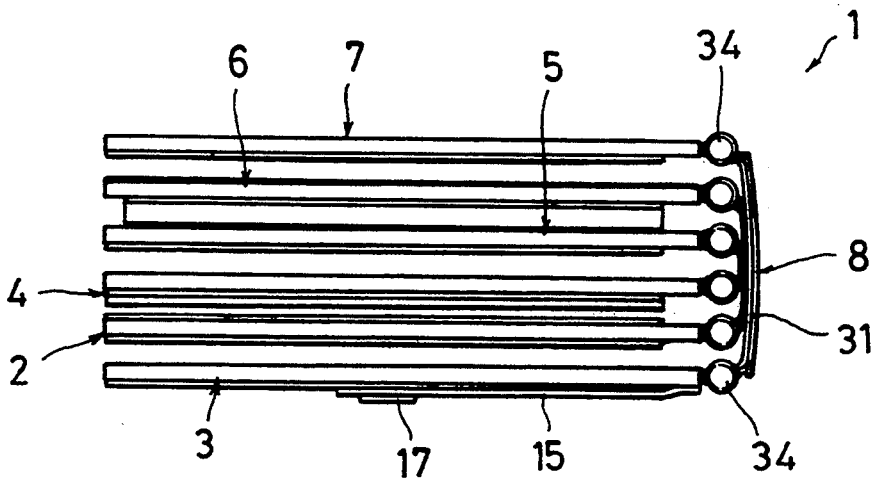
FIG. 2 is a plan view of the first embodiment.
Figure 3:
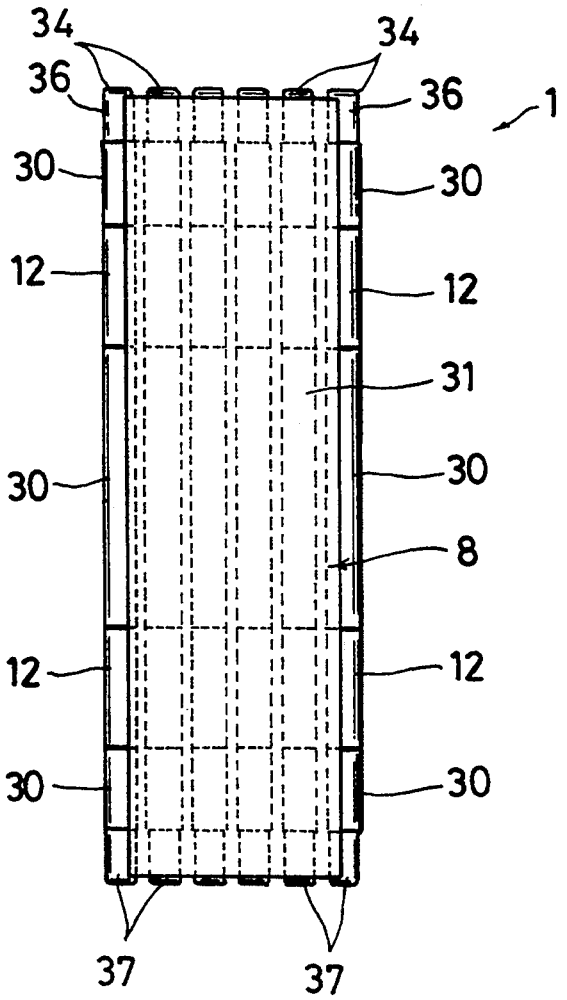
FIG. 3 is a back view of the first embodiment.

Preferred embodiments of the present invention will be described referring to the accompanying drawings.

A first embodiment of the present invention is illustrated in FIGS. 1 to 21 in the form of a purse 1 comprising a credit card holder member 2 for carrying a plurality of credit and bank cards, e.g. six cards in this embodiment, a coin case holder member 3 for metal money, a calling card holder member 4 for calling or business cards, a commutation ticket holder member 5 for commutation tickets, a banknote holder member 6 or 6A for paper money, a driver's license holder member 7 for a driver's licence, and a binder 8 for joining the foregoing holder members 2, 3, 4, 5, 6 or 6A, and 7 to a combination set.

Figure 4:
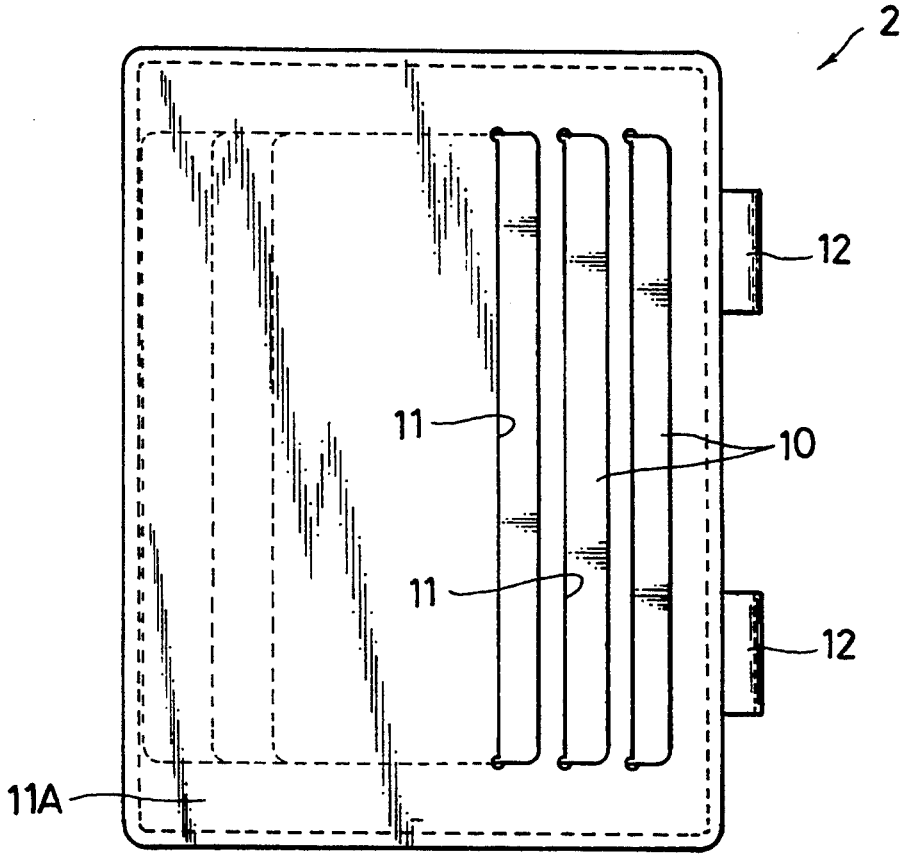
FIGS. 4 and 5 are explanation views of a holder member for holding cards.
Figure 5:
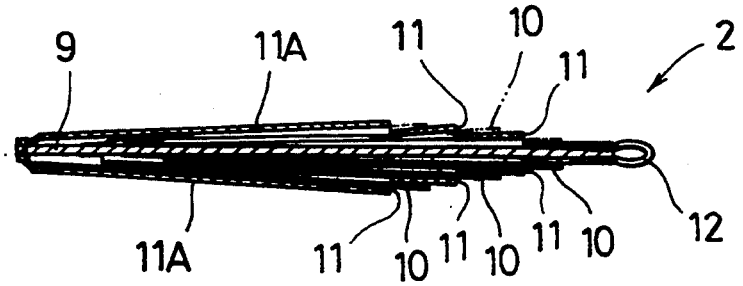

As shown in FIGS. 4 and 5, the credit card holder member 2 comprises a base plate 9 of rectangular shape which may be formed of a thick hard leather material, two surface sheets 11A, 11A formed of a leather material and fastened by stitching all the four edges to both sides of the base plate 9 respectively so that it can thoroughly cover the base plate 9, each surface sheet having a plurality of card pocket openings, for example, three 11, 11, 11 in this embodiment for holding three of the cards 10, 10, 10 at least, and two tubular joints 12, 12 fastened with stitches to the upper and lower close-to-edge portions of a pocket opening end or the right end of the base plate 9 respectively.

Figure 6:
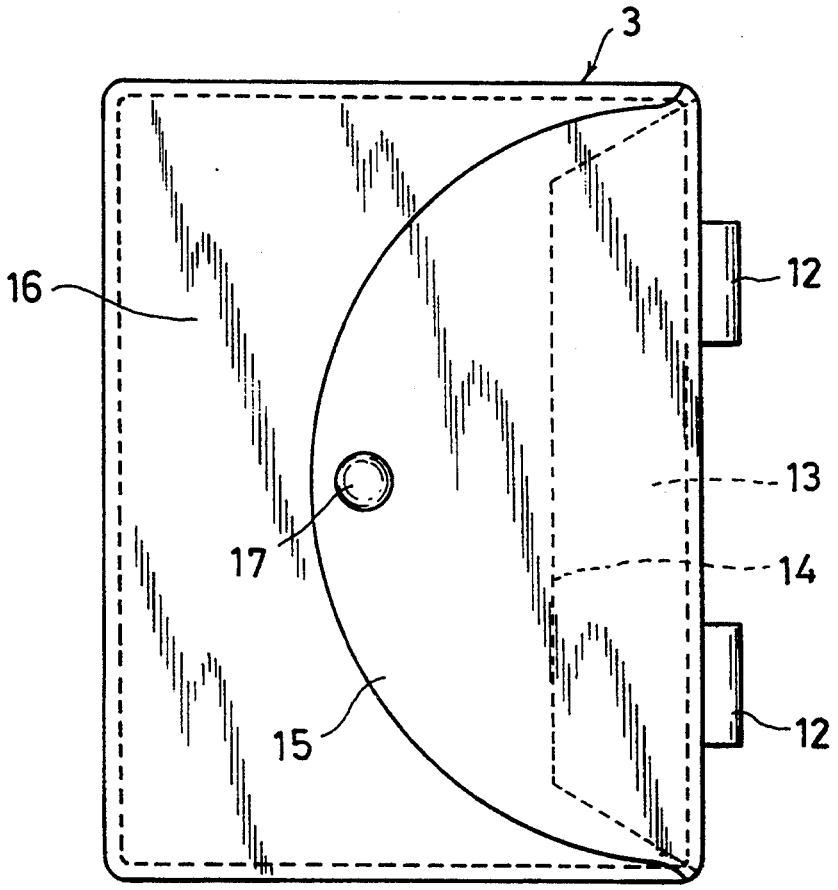
FIGS. 6 and 7 are explanatory views of a holder member for coins.
Figure 7:
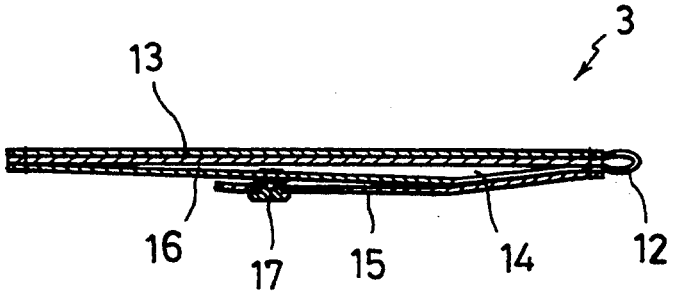

The coin case member 3 comprises, as shown in FIGS. 6 and 7, a base plate 13 shaped into almost the same size as of the base plate 9 of the credit card holder member 2, a coin holding case 16 having a flap 15 to close the opening 14 and fastened by stitching all the four edges to one side of the base plate 13 so that it can completely cover the side of the base plate 13, a snap fastener 17 for fastening the flap 15 to close the opening 14 of the coin holding case 16, and two tubular joints 12, 12 fastened with stitches to the upper and lower close-to-edge portions of a case opening end or the right of the base plate 13 respectively.

Figure 8:
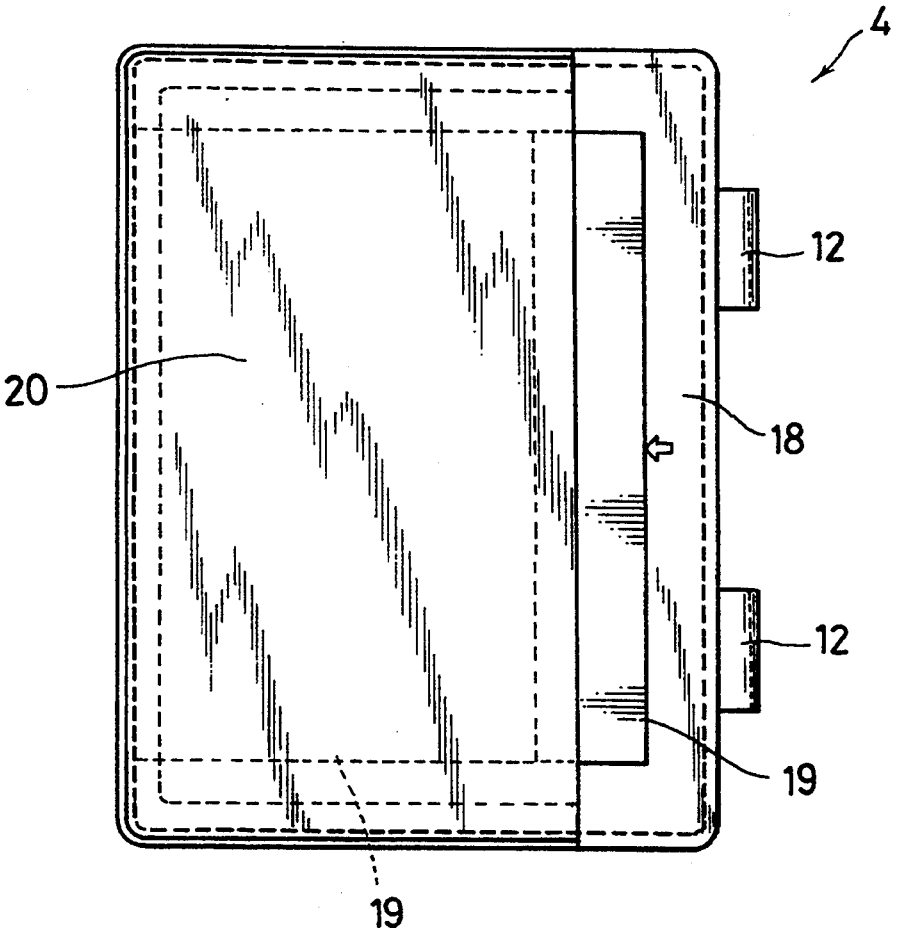
FIGS. 8 and 9 are explanatory views of a holder member for calling and business cards.
Figure 9:
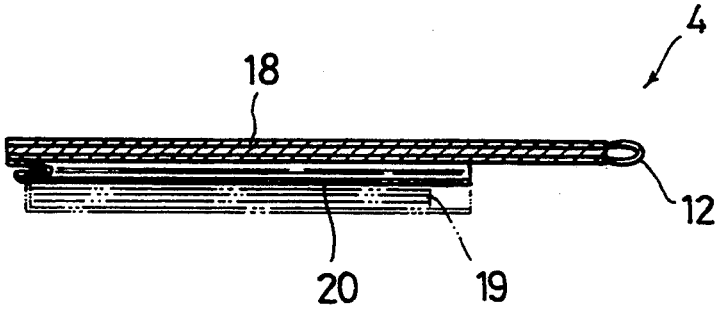

The calling card holder member 4 comprises, as shown in FIGS. 8 and 9, a base plate 18 shaped into almost the same size as the base plate 9 of the credit card holder member 2, a pocket sheet 20 fastened by stitching three edges, upper, lower, and left, to one side of the base plate 18 so that it can overlap the base plate 18 to form a pocket for holding calling or business cards, and two tubular joints 12, 12 fastened with stitches to the upper and lower close-to-edge portions of a pocket opening end or the right end of the base plate 13 respectively.

Figure 10:
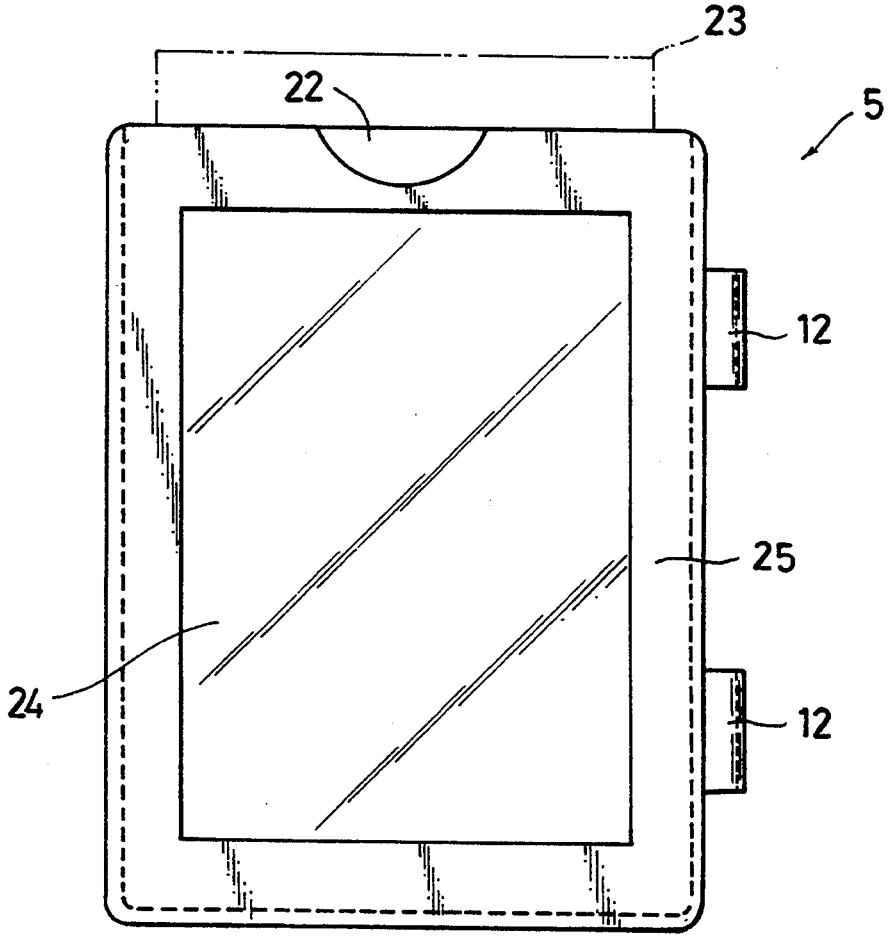
FIGS. 10 and 11 are explanation views of a holder member for carry a commutation ticket.
Figure 11:
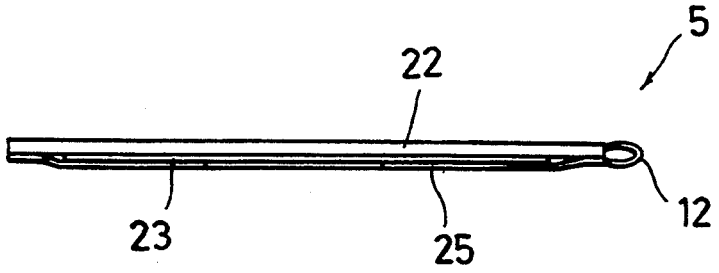

As shown in FIGS. 10 and 11, the commutation ticket holder member 5 comprises a base plate 22 shaped into almost the same size as the base plate 9 of the credit card holder member 2, a commutation ticket holder member 25 having a window 24 protected with a transparent plastic sheet and fastened by stitching three edges, left, right, and bottom, to one side of the base plate 22 so that it can completely cover the side of the base plate 22 while a commutation ticket 23 is insertable from the top, and two tubular joints 12, 12 fastened with stitches to the upper and lower close-to-edge portions of the right end of the base plate 22 respectively.

Figure 12:
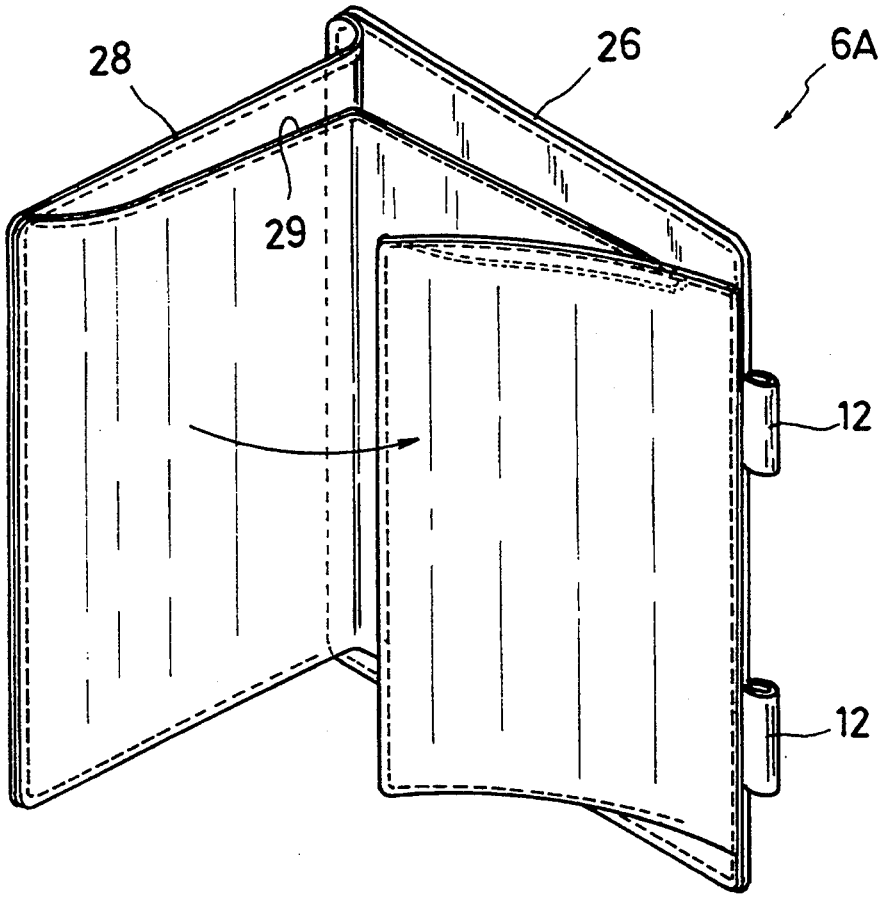
FIGS. 12 and 13 are explanatory views of a holder member for banknotes.
Figure 13:
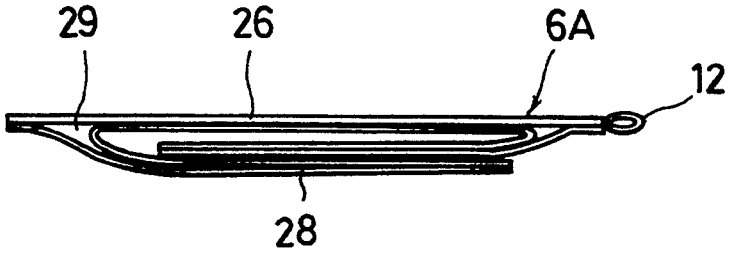

The banknote holder member 6 comprises, as shown in FIGS. 12 and 13, a base plate 26 shaped into almost the same size as the base plate 9 of the credit card holder member 2, a foldable pocket sheet 28 fastened by stitching three edges, left, right, and bottom center, to one side of the base plate 26 so that it can cover and fold down on the base plate 26 to form a wide pocket for holding banknotes or the like, and two tubular joints 12, 12 fastened with stitches to the upper and lower close-to-edge portions of the right end of the base plate 26 respectively.

Figure 14:
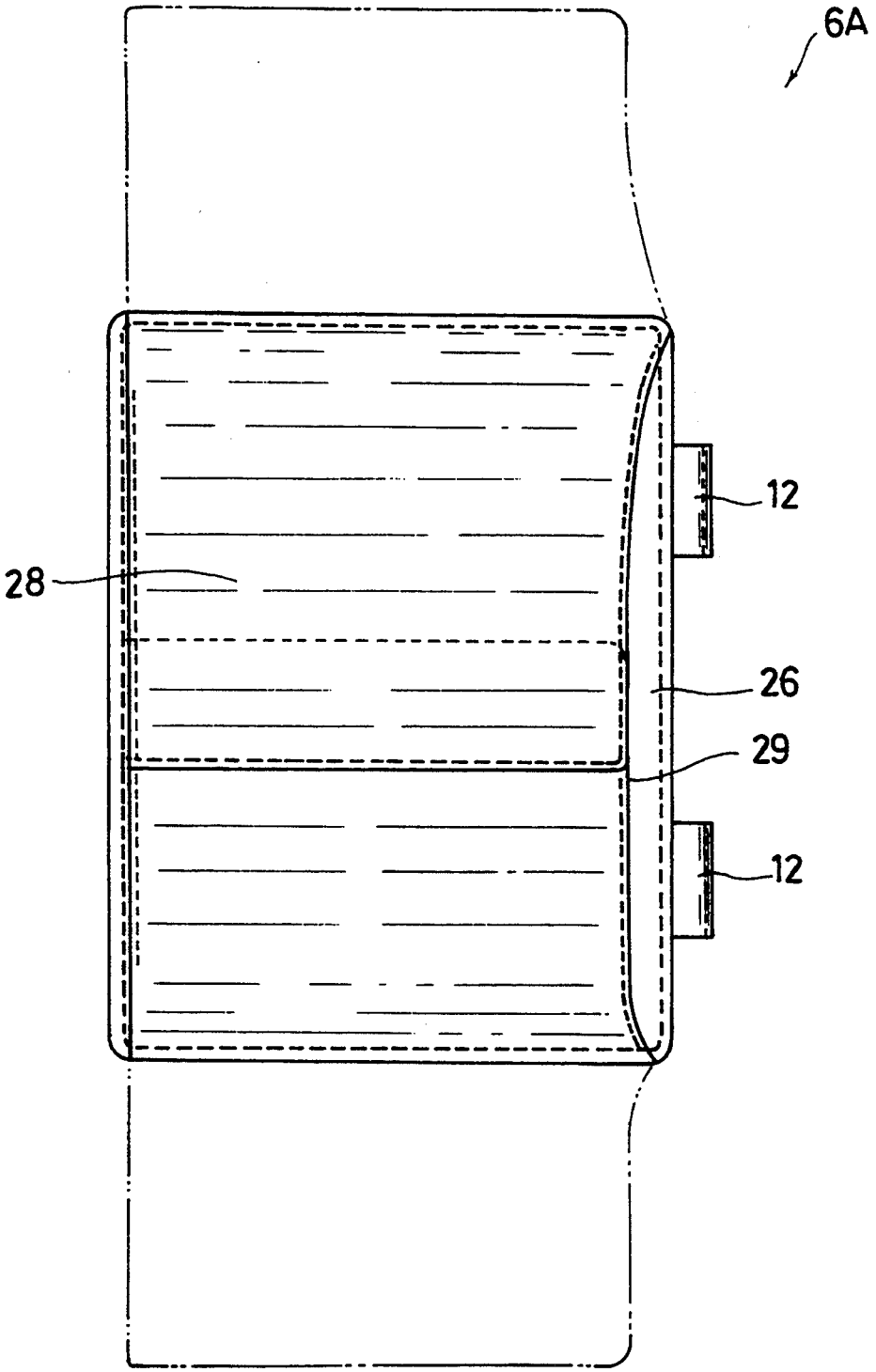
FIGS. 14 and 15 are explanatory views of another holder member for banknotes.
Figure 15:
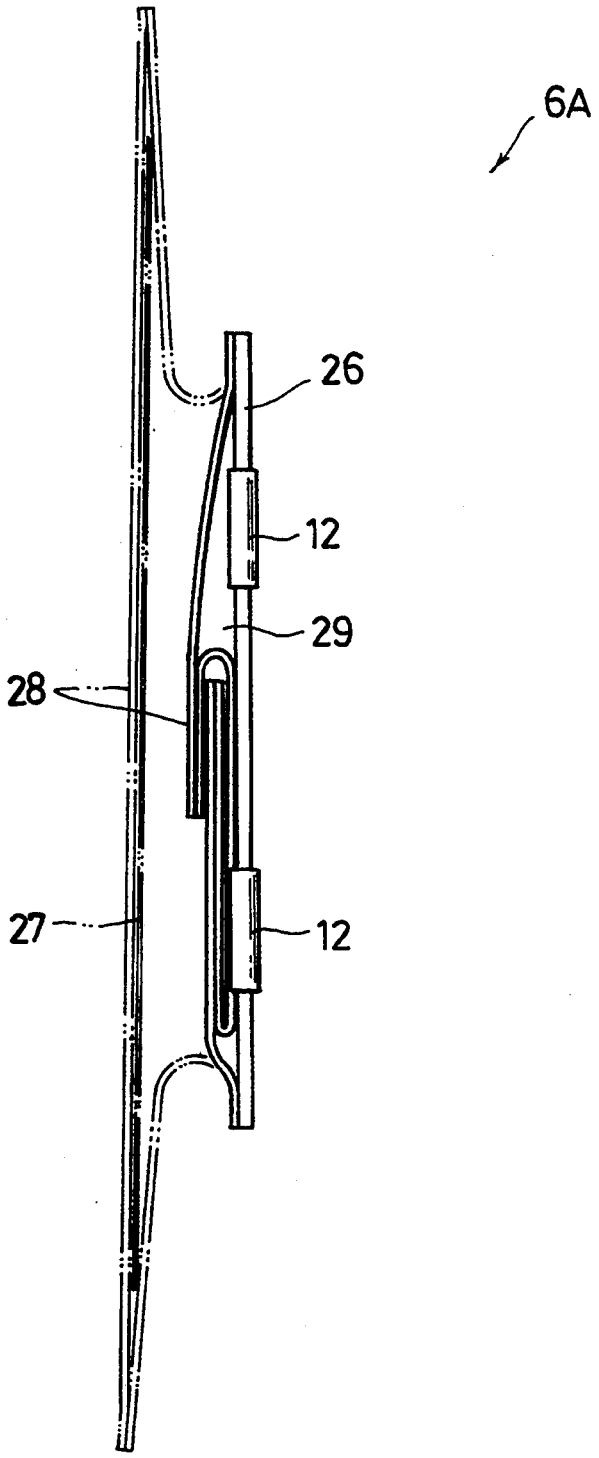

Also, the banknote holder member 6A of an alternative form comprises, as shown in FIGS. 14 and 15, a base plate 26 shaped into almost the same size as the base plate 9 of the credit card holder member 2, a foldable pocket sheet 28 fastened by stitching three edges, left center, upper, and lower, to one side of the base plate 26 so that it can overlap the base plate 26 to form a right-end-opening pocket for holding banknotes 27 and can be folded down from the upper and the lower, and two tubular joints 12, 12 fastened with stitches to the upper and lower close-to-edge portions of the right end of the base plate 26 respectively.

In particular, the banknote holder member 6A has the pocket opening at its right end and thus, allows the two joints 12, 12 to prevent escape of the banknotes 27 definitely.

Figure 16:
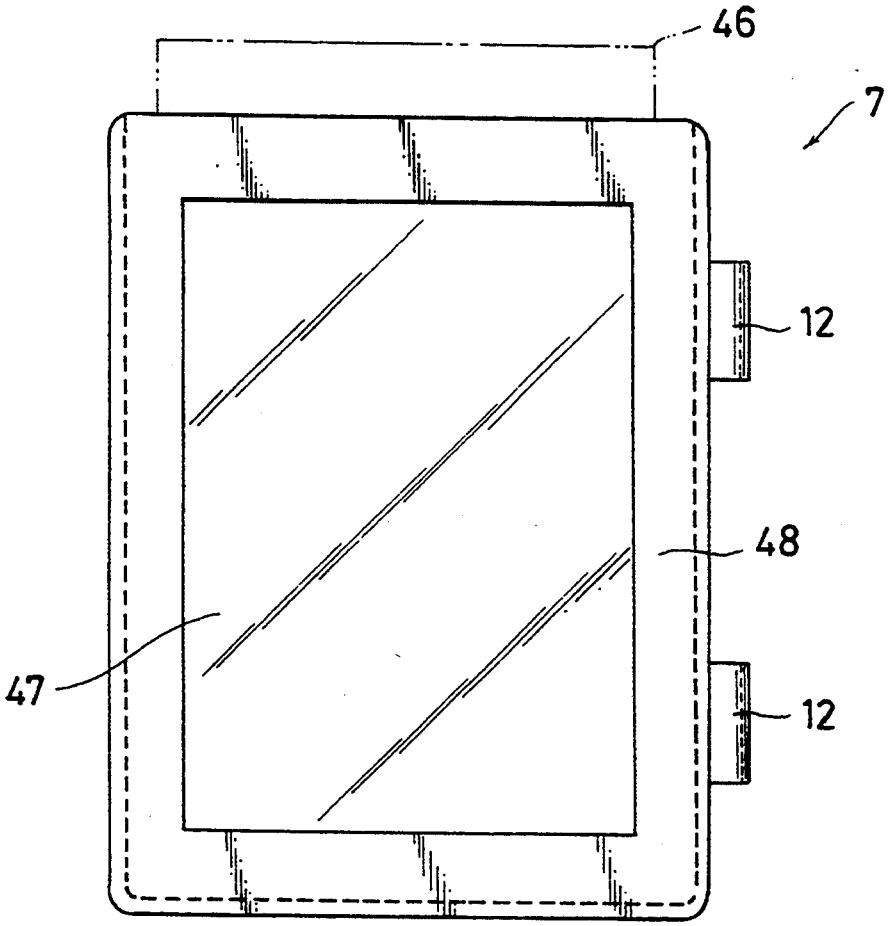
FIGS. 16 and 17 are explanatory views of a holder member for holding a driver's license.
Figure 17:
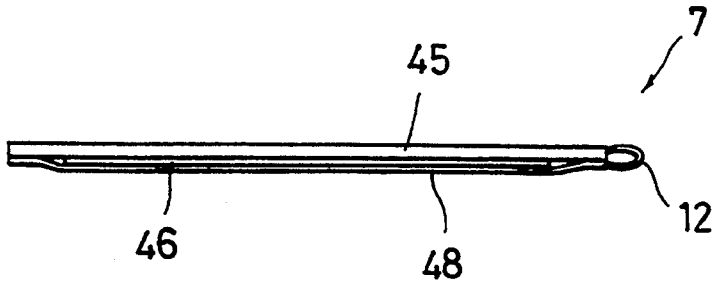
Figure 18:
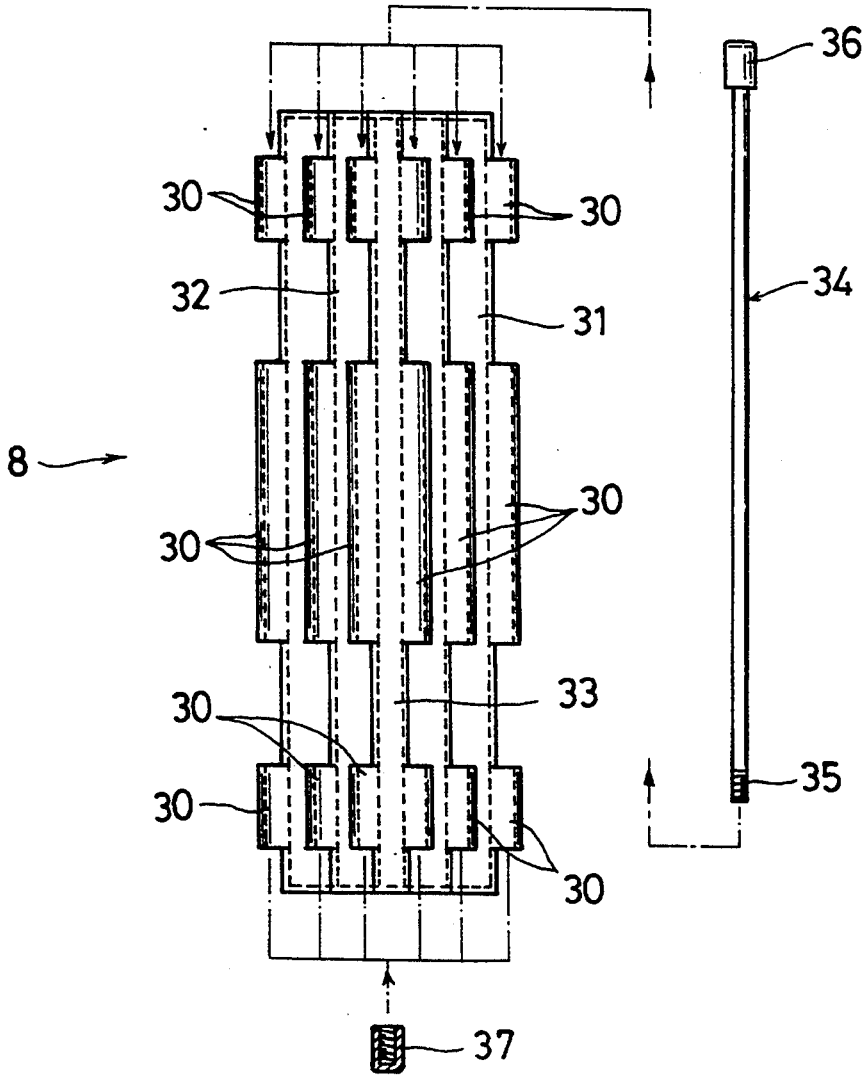
FIGS. 18 and 19 are explanatory views of a binder.
Figure 19:
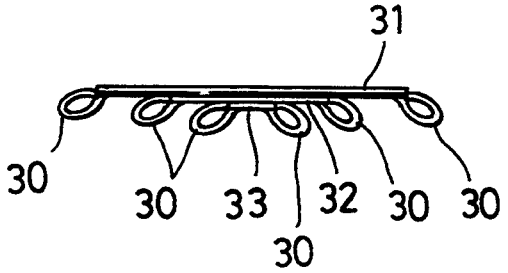

The driver's license holder member 7 comprises, as shown in FIGS. 16 and 17, a base plate 45 shaped into almost the same size as the base plate 9 of the credit card holder member 2, a drier's license holder member 48 having a window 47 protected with a transparent plastic sheet and fastened by stitching three edges, left, right, and bottom, to one side of the base plate 45 so that it can completely cover the side of the base plate 45 while a driver's license 46 is insertable from the top, and two tubular joints 12, 12 fastened with stitches to the upper and lower close-to-edge portions of the right end of the base plate 45 respectively. As best shown in FIGS. 18 and 19, the binder 8 comprises an outer binder strip 31 of leather material having a height identical to that of the holder members 2, 3, 4, 5, 6 or 6A, and 7 and provided at both side ends with tubular joints 30, 30, 30, 30, 30, 30 which are aligned to mate the tubular joints 12, 12 of any holder member in joining, an intermediate binder strip 32 of leather material having a width smaller than that of the outer binder strip outer binder strip 31 and provided with at both side ends with tubular joints 30, 30, 30, 30, 30, 30 which are aligned to mate the tubular joints 12, 12 of any holder member in joining, a center binder strip 33 of leather material having a width smaller than that of the intermediate binder strip outer binder strip 32 and provided with at both side ends with tubular joints 30, 30, 30, 30, 30, 30 which are aligned to mate the tubular joints 12, 12 of any holder member in joining, and six hinge pins 34, 34, 34, 34, 34, 34, each pin having at one end a head 36 and at the other end a thread 35 onto which a nut 37 identical in shape to the head 36 is screwed and adapted to extend through the tubular joints 30, 30, 30, 30, 30, 30 of the binder strip 31, 32, or 33 and the tubular joints 12, 12 of the holder member 2, 3, 4, 5, 6 or 6A, or 7 for joining the binder strip and the holder member.

Figure 20:
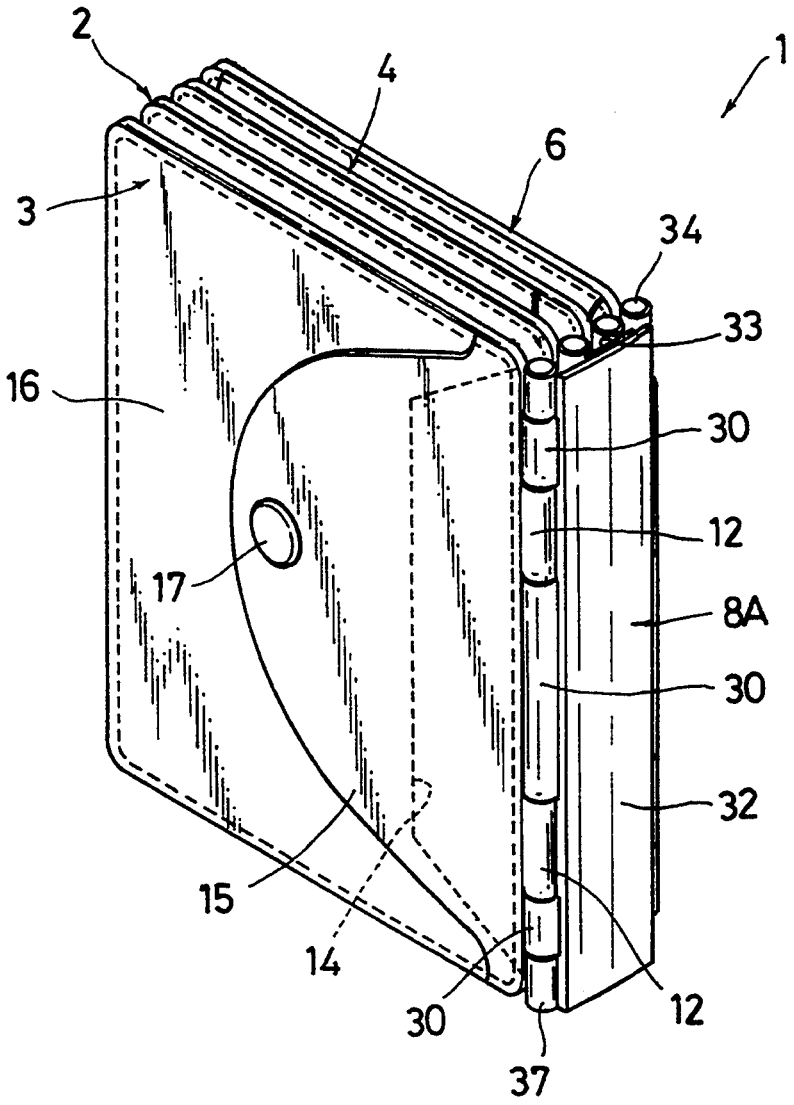
FIG. 20 is an explanatory view of another binder for joining four of the holder members.
Figure 21:
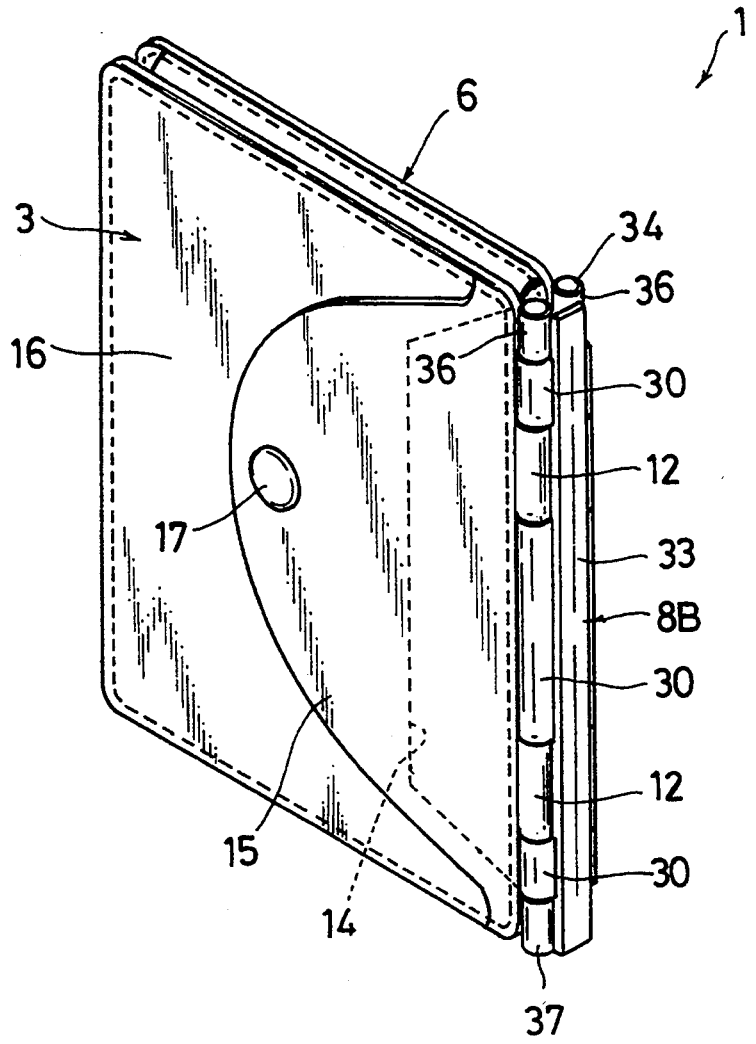
FIG. 21 is an explanatory view of a further binder for joining two of the holder members.

If the four holder members selected from the holder members 2, 3, 4, 5, 6 or 6A, and 7 are to be joined together in a combination as shown in FIG. 20, the binder 8 will be replaced with another binder 8A formed by fastening with stitches the center binder strip 33 to the intermediate joinder strip 32. For joining any two of the holder members, the binder 8 may be replaced with a further binder 8B consisting mainly of the center binder strip 33 as shown in FIG. 21.

Three or five of the holder members may be assembled together on the binder 8A or 8. Also, it is possible to provide a binder appropriated for joining only a definite number, e.g. three or five, of the holder members.

In the latter case, a specific binder strip is applicable having the tubular joints aligned on one side end only.

Other embodiments of the present invention will now be described referring to FIGS. 22 to 31. Throughout the figures, like components are denoted by like numerals as those of the first embodiment and will no more be explained.

Figure 22:
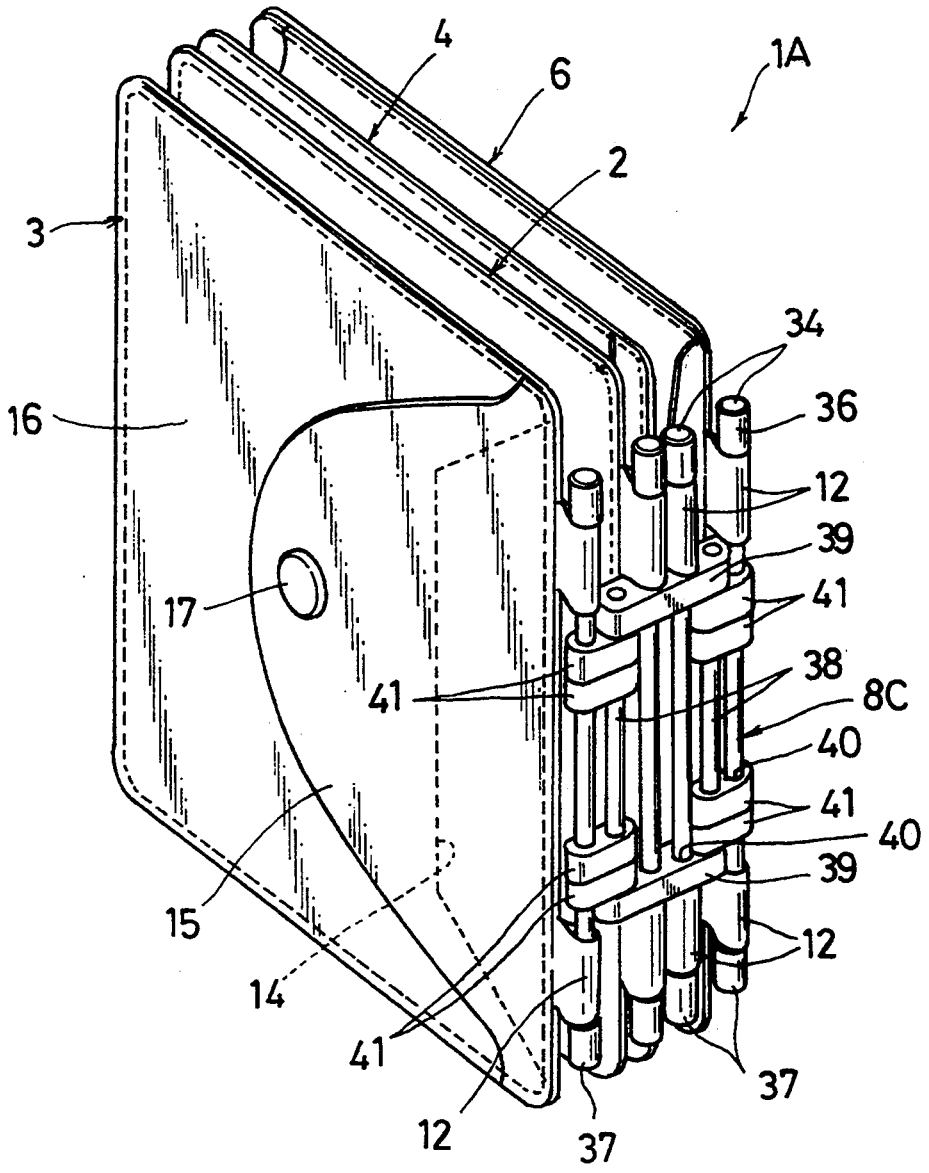
FIGS. 22 to 24 are explanatory views showing a second embodiment of the present invention.
Figure 23:
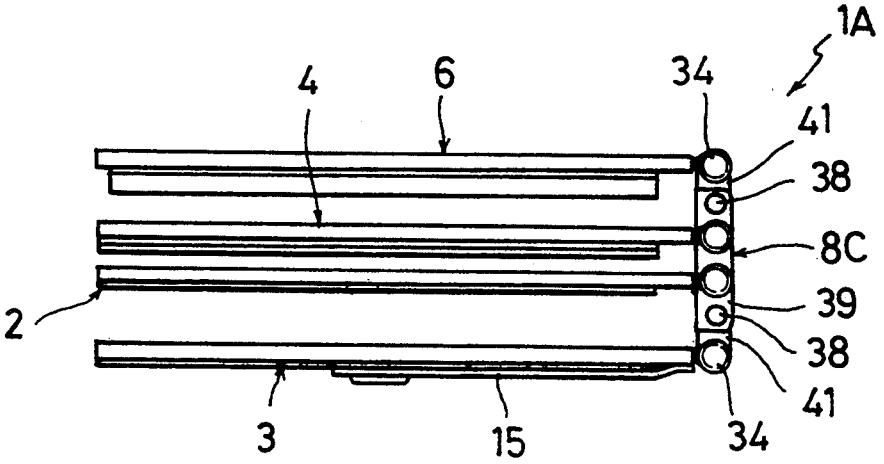
Figure 24:
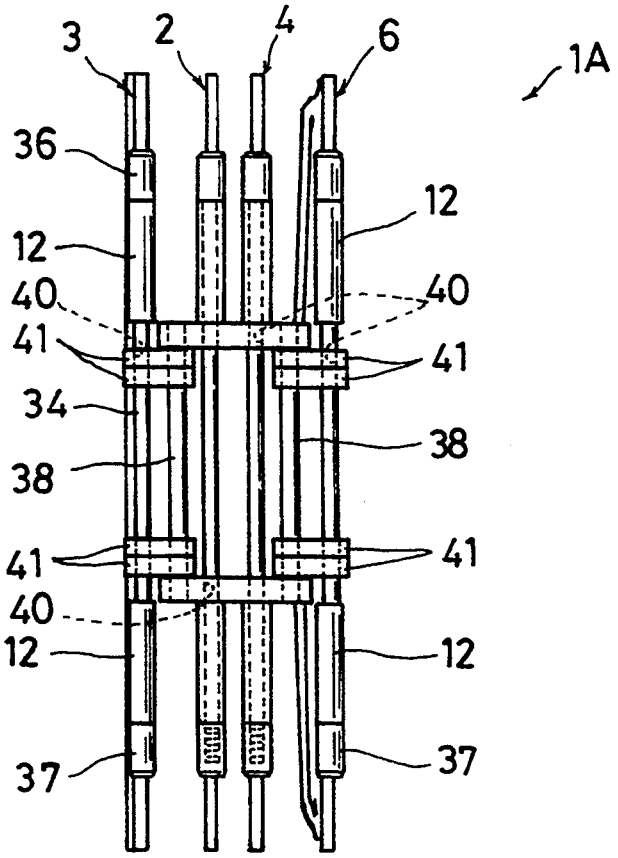

FIGS. 22 to 24 illustrate a second embodiment of the present invention which is differed from the first embodiment by the fact that a binder 8C comprises a pair of support bars 39, 39 joined at both ends each other by two support pins 38, 38, and a plurality of or at least four joint blocks 41, 41, 41, 41 mounted to the support bars 39, 39. Each of the support bars 39, 39 and the joint blocks 41, 41, 41, 41 has two pin insertion holes 40, 40 provided therein for accepting the hinge pins 34, 34 respectively.

Accordingly, a desired combination of the holder members selected from 2, 3, 4, 5, 6 or 6A, and 7 can successfully be assembled with the binder 8C of the second embodiment, ensuring the same advantages as of the first embodiment.

Figure 25:
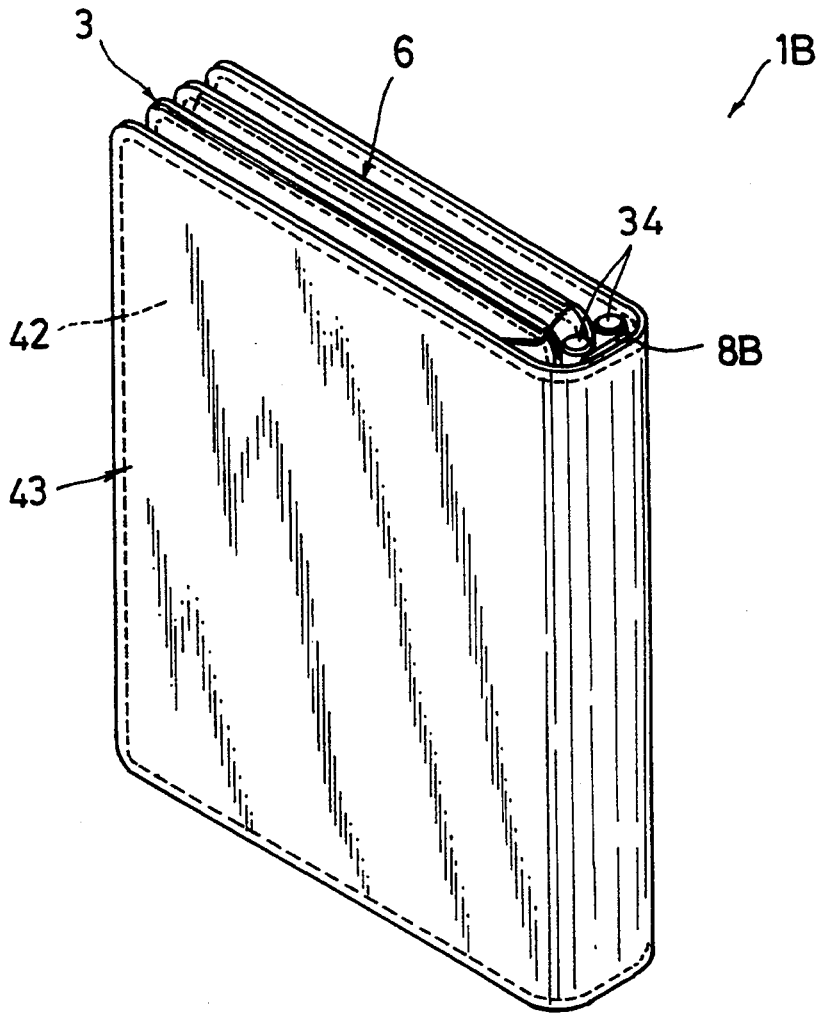
FIGS. 25 to 27 are explanatory views showing a third embodiment of the present invention.
Figure 26:
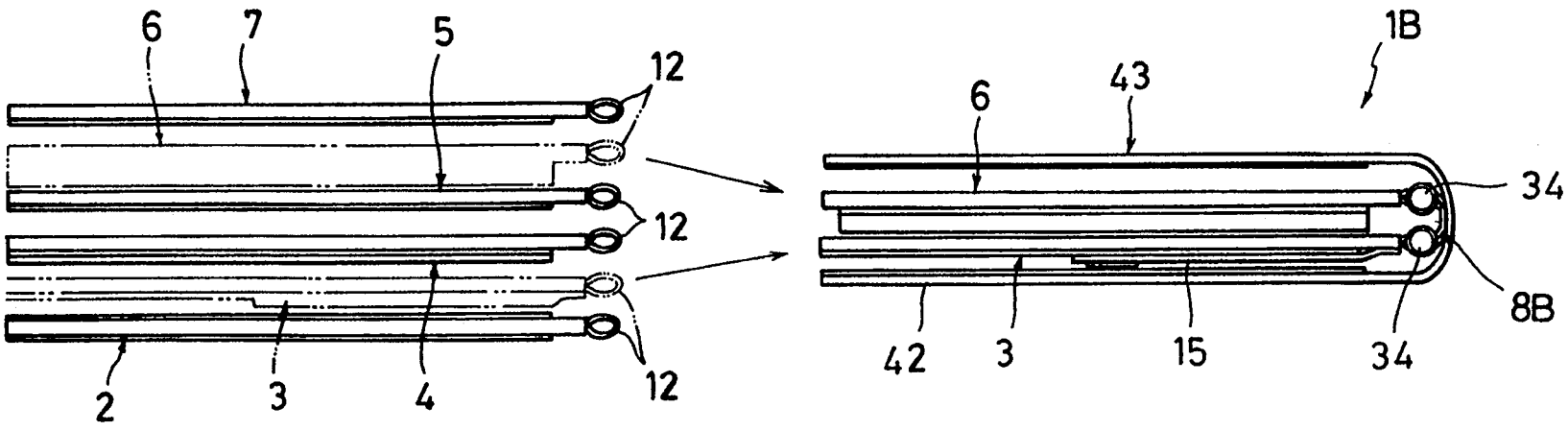
Figure 27:
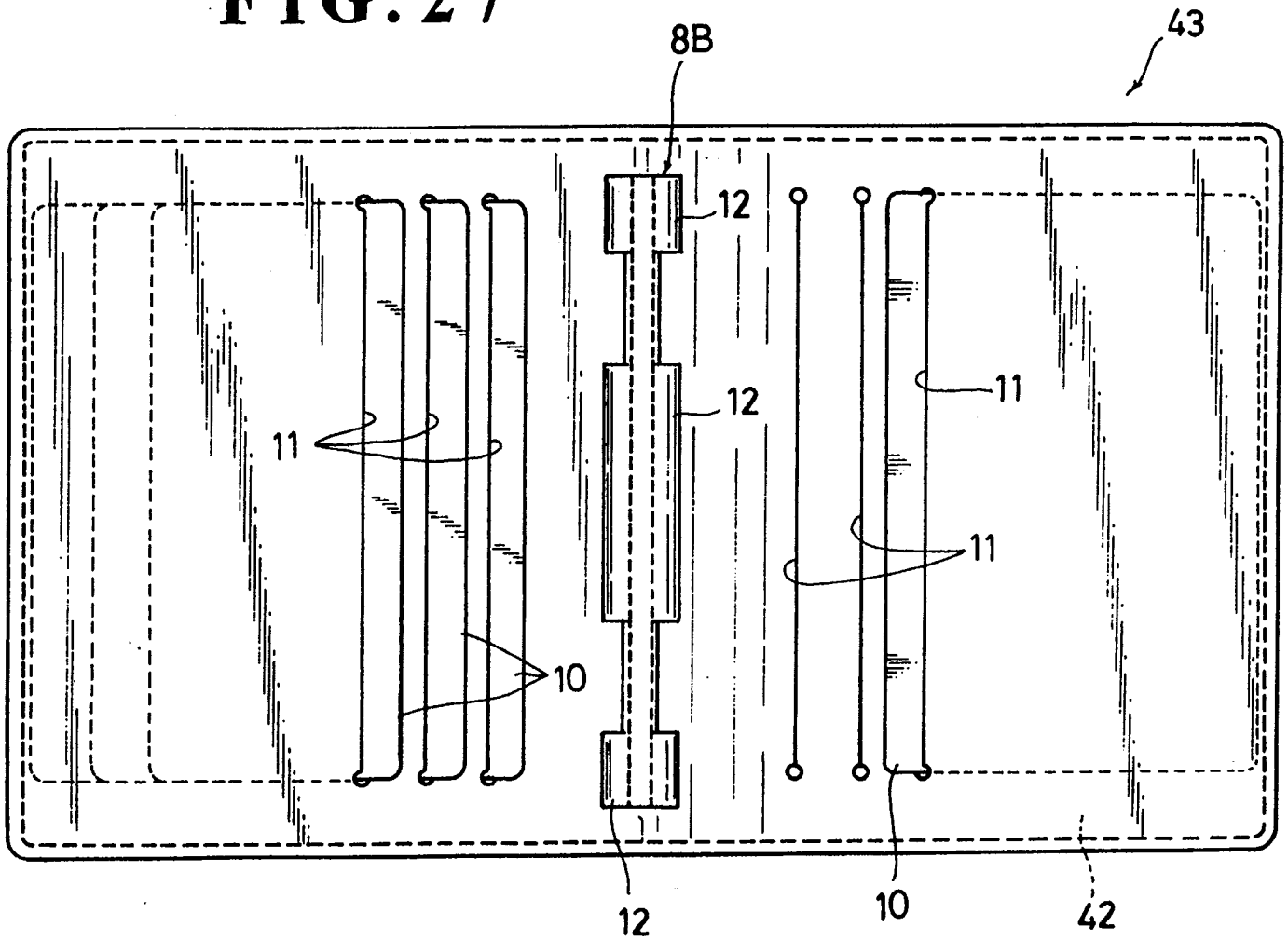
Figure 28:
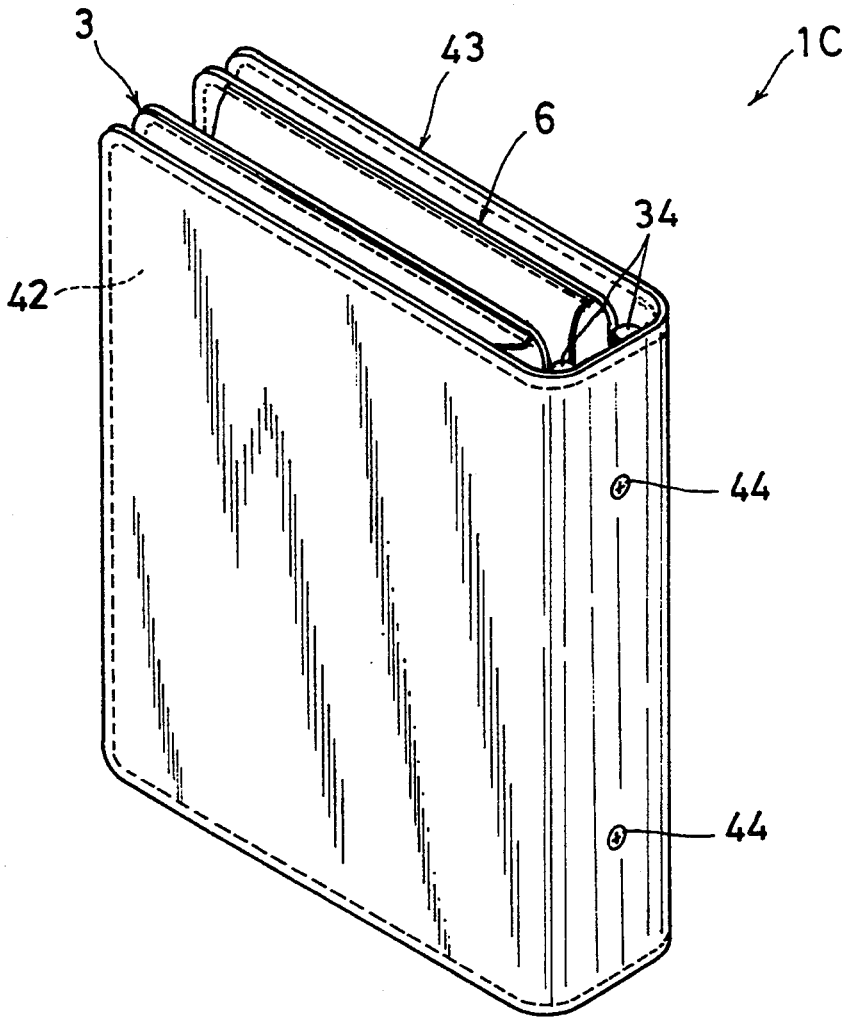
FIGS. 28 to 31 are explanatory views showing a fourth embodiment of the present invention.
Figure 29:
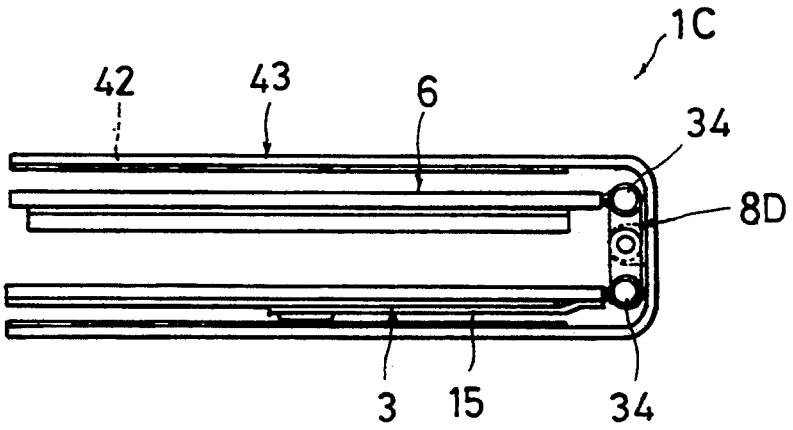
Figure 30:
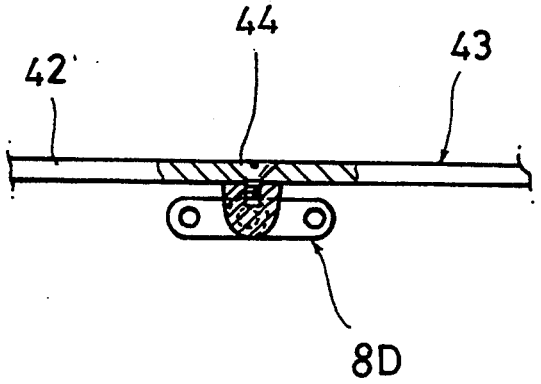
Figure 31:
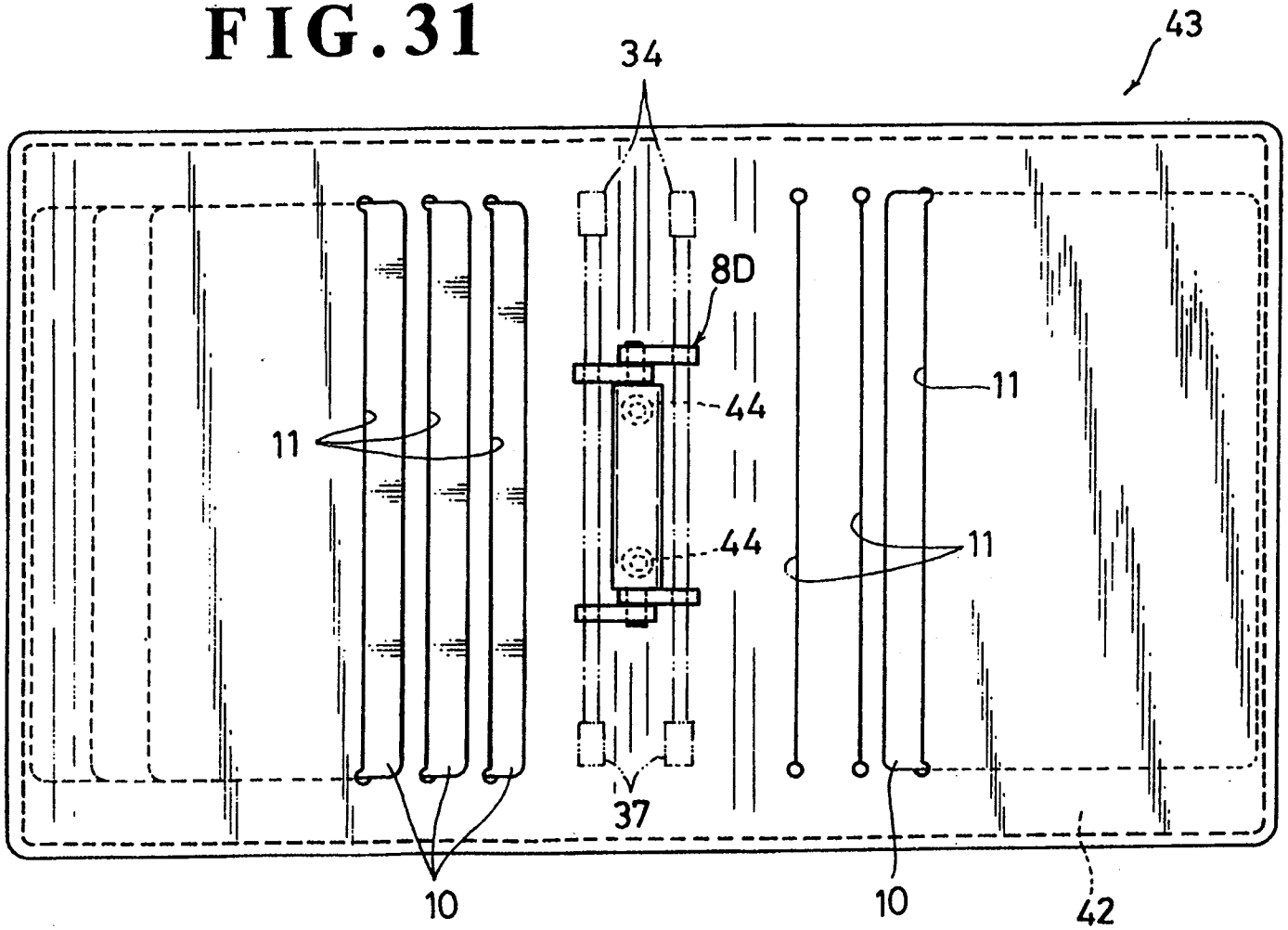

FIGS. 25 to 27 show a third embodiment of the present invention which is differed from the first embodiment by the fact that the binder 8B, which carries a desired pair of the holder members selected from 2, 3, 4, 5, 6 or 6A, and 7, is mounted to a center region of the inner side of an outer purse cover 43 which comprises an outer cover base plate 42 having a size substantially two times greater than that of the base plate 9 of the credit card holder member 2 so that it can be folded down in half along the binder 8B. The outer cover base plate 42 has a plurality of card holding slits 11 arranged in the inner side thereof for holding a corresponding number of cards 10. Accordingly, a resultant purse 1B can provide the same advantages as of the first embodiment.

FIGS. 28 to 31 shows a fourth embodiment of the present invention which is differed from the third embodiment by the fact that the binder 8B is replaced with a metal binder 8D detachably mounted to the outer cover base plate 42 with a plurality of or at least two screws 44, 44. Accordingly, a resultant purse 1C can provide the same advantages as of the third embodiment.

It should be understood that the holder or case member of the purse is fabricated in any possible holder configuration on one or both sides by selecting from the credit card, calling card, commutation ticket, banknote, and driver's license holders, a coin case, and other applicable forms.

As apparent from the foregoing descriptions, the advantages of the present invention are as follows:

(1) A plurality of holder members for a purse, each having a base plate arranged at one or both sides pockets or cases for carrying any of credit cards, bank cards, calling cards, commutation tickets, a driver's license, coins, banknotes, etc. and provided at one edge with joints, are applicable and a desired number of them can be joined together with a binder through their joints in order to form a particular configuration of the purse which is required by a user. The purse according to the present invention will thus satisfy the demand of every user.

(2) According to the paragraph (1), a desired one of the holder members can be added or replaced with ease for optimum modification of the purse configuration.

(3) According to the paragraph (1), the purse according to the present invention employs a combination of the holder members which can be fabricated at a lower cost than that of a conventional purse and suited for mass production.

(4) According to the paragraph (1), the construction of each component of the purse according to the present invention is relatively simple and can be fabricated with much ease.

What is claimed is:

1. A purse comprising a binder and at least three different holding members selected from a plurality of holding members comprising:

a credit card holding member comprising a base plate, at least one surface sheet attached to at least one side of said base plate for holding a plurality of cards, said at least one surface sheet having an opening for receiving a card;

a coin holding member comprising a base plate and a case for holding coins attached to said base plate;

a banknote holding member comprising a base plate having at least two end portions and a foldable pocket sheet attached to said base plate, said foldable pocket sheet being folded down on said base plate on said at least two end portions thereof for holding banknotes;

a driver's license holding member comprising a base plate and a means for holding a driver's license attached to said base plate;

a business card holding member comprising a base plate and a sheet having a pocket for holding business cards attached to said base plate; and a commutation ticket holding member comprising a base plate and a means for holding a commutation ticket, said commutation ticket holding means having a transparent window for displaying said commutation ticket;

each of said holding members having two tubular joints attached to their respective base plates for attaching each of said holding members to said binder.

2. The purse of claim 1, wherein said coin holding member has a flap attached to said case and fastened by a fastener for retaining coins in said case.

* * * * *